US006021788A

United States Patent [19]

King

[11] Patent Number: 6,021,788

[45] Date of Patent: Feb. 8, 2000

[54] APPARATUS AND METHOD FOR WASHING ARTICLES

[76] Inventor: Kenyon M. King, 8739 Lion St., Rancho Cucamonga, Calif. 91730

[21] Appl. No.: 08/972,335

[22] Filed: Nov. 18, 1997

[51] Int. Cl.[7] ..... B08B 9/20; B08B 5/00; B08B 3/00

[52] U.S. Cl. ..... 134/25.2; 134/18; 134/25.1; 134/26; 134/28; 134/30; 134/102.2; 134/102.1

[58] Field of Search ..... 134/102.1, 102.2, 134/25.1, 25.2, 25.3, 25.4, 34, 37, 22.15, 22.18, 57 D, 56 D, 58 D, 18, 26, 29, 30; 68/183

[56] References Cited

U.S. PATENT DOCUMENTS

| | | | |
|---|---|---|---|
| 4,635 | 7/1846 | Smith . | |
| 654,647 | 7/1900 | Kuppelmann | 134/102.2 |
| 732,637 | 6/1903 | Insley | 134/102.2 |
| 1,036,988 | 8/1912 | Fink . | |
| 1,771,436 | 7/1930 | Guett | 134/102.2 |
| 2,115,662 | 4/1938 | Dawson | 134/102.2 |
| 2,725,062 | 11/1955 | Vile | 134/102.2 |
| 3,050,422 | 8/1962 | Zak | 134/102.2 |
| 3,094,740 | 6/1963 | Reeves | 134/102.2 |
| 3,799,179 | 3/1974 | Thomas | 134/95.1 |
| 4,080,975 | 3/1978 | Williams, Jr. | 134/94.1 |
| 4,235,642 | 11/1980 | Federighi et al. | 134/58 D |
| 4,967,777 | 11/1990 | Takayama et al. | 134/102.2 |
| 5,000,795 | 3/1991 | Chung et al. | 134/37 |
| 5,184,635 | 2/1993 | Tromblee et al. | 134/111 |
| 5,357,992 | 10/1994 | Yang | 134/107 |
| 5,375,992 | 12/1994 | Kruder et al. | 425/208 |
| 5,419,353 | 5/1995 | Chen | 134/102.1 |

*Primary Examiner*—Randy Gulakowski
*Assistant Examiner*—Alexander Markoff
*Attorney, Agent, or Firm*—Leo R. Carroll

[57] ABSTRACT

This invention includes apparatus that circulates and agitates a liquid cleansing solution in a sink by means of gas jet bubbles, in order to clean dirty articles therein. The basic device comprises a base structure, a pressurized gas supply, hollow jet nozzle means disposed in the sink, the jet nozzle means having a sealed end and a plurality of apertures thereon for gas ejection, so as to produce gas bubble jet streams which scrub and clean the articles by both article impact and agitation of the liquid cleansing solution. Preheating of the pressurized gas, coupled with a manifolded heat exchanger in the cleansing solution, provides the means for heating the cleansing solution. Temperature control means are then used to maintain the temperature of the cleansing solution against cooling. Alternately, the heat source may include a separate liquid heater. The warmed gas may also be used to dry the articles after washing.

29 Claims, 7 Drawing Sheets

APPARATUS AND METHOD FOR WASHING ARTICLES

DESCRIPTION

1. Technical Field

This invention relates generally to apparatus and methods for washing articles and especially to restaurant sink devices into which dirty pots, pans and other items required for food production are generally placed for soaking and/or later washing. The restaurant industry experiences naturally heavy peak rush periods set by the common eating schedules of its patrons. During these peak rush periods the restaurant employees are concentrating on the production of food ordered by the patrons, with general heavy clean up tasks postponed until later.

2. Background Art

Although steam cleaning, as in U.S. Pat. No. 4,366,005 to Oguri et al, has long been applied to industrial cleaning devices, pressurized liquid systems continue to dominate the art. U.S. Pat. No. 5,184,635 to Tromblee et al shows a fluid handling system, and U.S. Pat. No. 3,847,666 to Jacobs, show washer improvements. For heating system improvements, see U.S. Pat. Nos. 5,357,992 to Yang, and 4,439,242 to Hadden.

Automatic dishwashing apparatus are also available in large serial equipment lines suitable for institutional use, such as U.S. Pat. No. 3,724,636 to Wright. Although this equipment comprises a single line of stations, parallel line equipments exist as in U.S. Pat. No. 4,088,145 to Noren for a tandem rack dishwashing machine.

Another type of foodware cleaning system is shown in U.S. Pat. No. 4,147,558 to Fraula, et al, in which the functions of rinsing and sanitizing are combined in separate apparatus so as to allow utilization of low temperature water.

Unfortunately, the size and cost of all of the above machines limit their use in average restaurants and fast food establishments, and none utilize gas jets in a cleansing solution.

DISCLOSURE INVENTION

This patent describes apparatus and methods of cleaning articles in a sink by means of gas agitation of the cleansing solution surrounding the articles. A pressurized gas such as air, when jet blown into a cleansing solution, produces a bubble stream which scrubs the articles by impact and by creating turbulent flow in the solution. When the gas is preheated, it may also be used to maintain the temperature of the cleansing solution temperature over a controlled cleaning cycle.

In a first embodiment, a gas pump and heater unit blows warm gas through a manifold, which then diverts the gas through tubing connected to an immersed tube, pan, or other heat exchanging device. This heat exchanger thus provides the heat required to sustain the water temperature. After leaving the heat exchanger, the cooler gas is passed through a blind section of tubing having small apertures thereon which serve as multiple jet nozzles. The gas ejected through the nozzles expands and creates bubbles which rise to the surface of the water. This bubble movement causes the water to circulate in the sink and at the same time the water becomes agitated. The pots, pans or other items placed in the sink inhibit laminar flow and further contribute to turbulent flow conditions. The increased impact forces and the swirling flow motion on the dishware creates an effective scrubbing action which assists in the separation of greases, burned carbon, and food matter from the dishware.

This embodiment of the invention includes both gas pressure and water temperature controls. Although many conventional control means may be utilized, the embodiment shown herein comprises a closed loop system which regulates a gas flow valve in order to bypass the gas flow away from the exhaust jets. As the bubble action is throttled downward, less heat is lost through excessive bubbling and the water temperature may be better controlled. When the bubble action is set at the lowest flow rate for effective scrubbing, the power required for the gas pump/heater combination will also be minimized.

Although the prime application of this cleaning system has been set forth as addressing the problems of cleaning soiled pots, pans and cooking utensils in a sink in a busy commercial environment, the system may be easily adapted to cleaning other forms of dishware, including ceramics, silver utensils and china. Likewise, the using environment can be extended to include home dishwashing methods and apparatus. It will be noted that some classes of items may be sufficiently cleaned in the sink so as to not require a separate final washing. It may be adequate to simply drain the sink, and then use the forced gas jets to provide drying, thereby eliminating the need for a separate dryer. With other items, additional cycles of clean water rinses interposed with additional drain and hot forced gas drying cycles may be desirable and can be easily added. In a second embodiment of this invention, electric immersion heaters may be utilized in the sink, rather than gas heating as previously described. Temperature control of the immersion heaters is accomplished by conventional electric control means. The elimination of the external gas heater and heat exchanging controls results in a simpler, less expensive embodiment which is more readily adapted to existing sink facilities. Versions of this embodiment have also been designed for both free standing and counter top sinks.

It has also been found that detergent that has been spread over and within the items to be cleaned, will be more completely dissolved in less time with the jet action, resulting in lower soap residue on the dishware.

The use of this device has been found to effectively scrub the pots and pans so that a later wash process may not be needed. Rather than sit and soak in a sink, waiting for the peak rush period to end, the items in the sink may be productively cleaned in a time saving manner.

This invention therefore, not only saves labor, but also reduces both capital cost and energy cost over prior art cleaning means. In addition, since the restaurant industry is plagued by high turnover and accidents, this device should reduce turnover by reducing unpleasant tasks such as scrubbing of pots and pans. Further, the associated reduction in overall handling should reduce slip and fall accidents, and the reduction in handling of sharp utensils will therefor reduce cutting injuries.

It is also recognized that potential uses of this invention may be extended beyond cleaning dishware in soapy water. Commercial applications, for instance, can include cleaning of parts or other articles in garages or industries in which the cleansing solutions various solvents or degreasing agents.

The prime objective of this invention is to provide a sink washing system which will remove food, grease and soap from pots, pans and other dirty articles by utilizing a pressurized gas stream which is jet ejected in order to agitate a cleansing solution and jet scrub the articles.

It is a another object of this invention to provide a sink washing system in which the gas is heated outside of the solution and passed through a heat exchanging apparatus in order to maintain the cleansing solution at a controlled temperature.

It is yet another object of this invention to provide a sink washing system for existing sinks in which the cleansing solution is separately heated.

It is still another object of this invention to provide an automatic gas flow control system for jet washing pots, pans and other dirty articles in a sink containing a temperature controlled cleansing solution.

It is an additional object of this invention to provide a sink agitator system that will remove food and grease from pots, pans and other dirty articles in a reduced time period.

It is a further object of this invention to provide a system for agitation of a cleansing solution that can be installed in existing sinks in counter tops.

The above and other objects, features and advantages of the present invention will become more apparent from the following description when making reference to the detailed description and to the accompanying sheets of drawings.

BEST MODES FOR CARRYING OUT THE INVENTION

Figure 1:
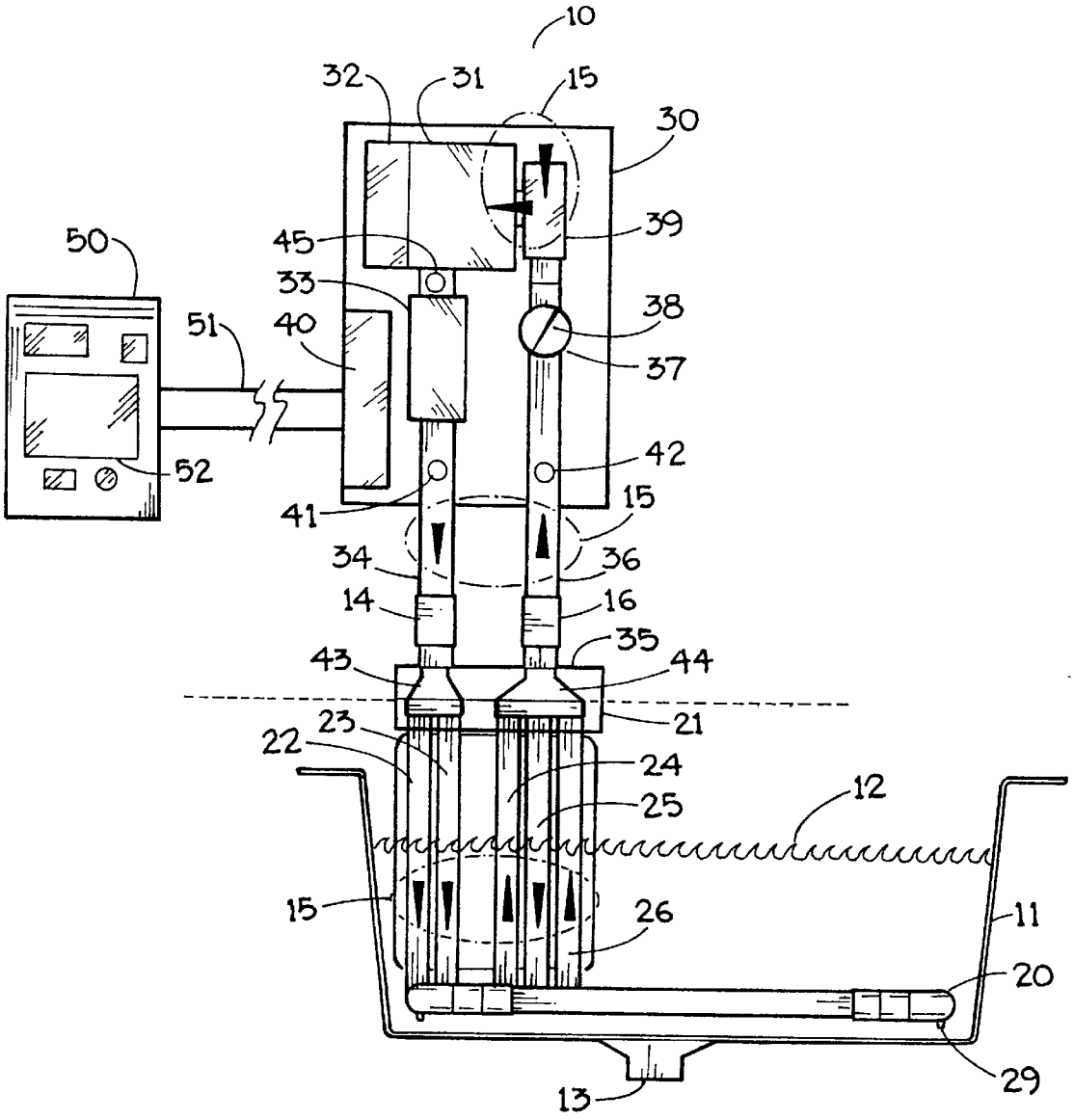
FIG. 1 is a front cross-section of a washing sink, fitted with a mechanical schematic of the heat exchanger, jet nozzle assembly, a blower, a heater, a control and sensing assembly and a control panel.

FIG. 1 shows a front cross-section of a typical sink 11, partially filled to a surface level with a liquid cleanser means such as water and a detergent, with the major elements of this invention attached thereto. These elements may be individually attached to a common building structure such as a wall, or may be partially connected together by means of a common base structure (not shown).

The major elements are grouped as upper and lower portions, which are separable at slip joints 14 and 16. The lower portions, as viewed progressively downward from the slip joints, include manifold 35, which is attached to upstanding tubes 22, 23, 24, and 25, which in turn are attached to a lower horizontal portion. The major elements include a removable lower portion containing a manifolded heat exchanging tube/jet nozzle means 20, supported within sink 11 by means such as feet 29. Sink 11 includes drain means 13, which may be conventionally connected to garbage disposals, traps and/or other sewer line connection means that are not shown. Likewise, conventional faucet means for filling the sink are not shown.

Mounted above the heat exchanging tube/jet nozzle means assembly 20 is an upper portion containing a combined gas supply/heater/gas control system 30, connected through tube joints 14, 16 to manifold 35 which is attached to the lower unit 20 through upstanding tubes 22, 23, 24, 25, and 26. FIG. 1 depicts this upper portion in a mechanical schematic format, with the manifold and tubing shown in cross section. Also illustrated is a front view of a separate electrical control unit 50, which is electrically connected to upper portion 30 by means of cable 51. Shown on control unit 50 is front panel 52, which contains display and switching elements necessary for operational process control.

Figure 2:
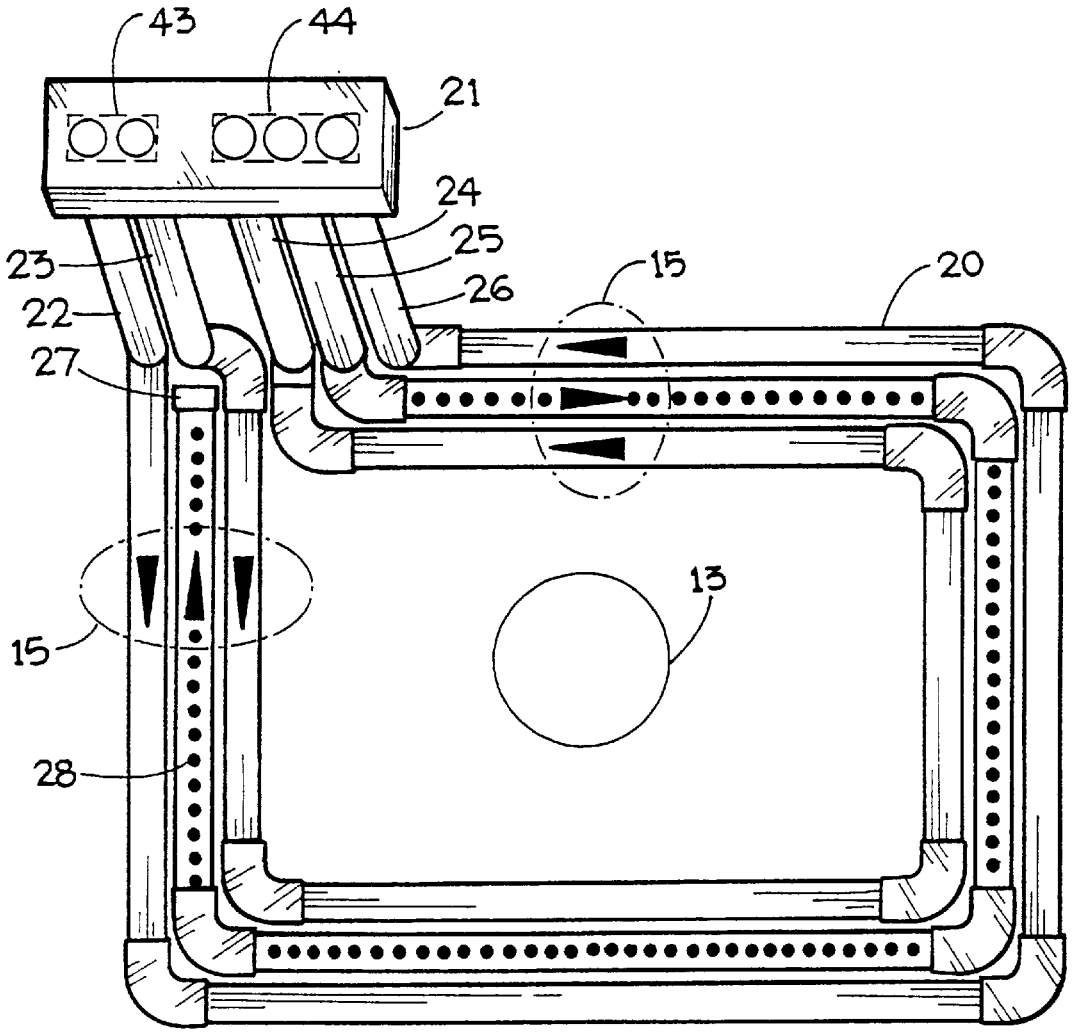
FIG. 2 shows an expanded top isometric view of the heat exchanger and jet nozzle assembly.

FIG. 2 shows an expanded isometric of the lower portion which contains the manifolded heat exchanging tube/jet nozzle means assembly 20, as viewed below section line a—a through manifold 35 in FIG. 1. Referring to FIGS. 1 and 2, pressurized gas is generated by a turbine type blower 31 driven by electric motor 32. The pressure of the gas is monitored by a pressure sensor at port 45, and the temperature of the gas is sensed at 41. This gas is heated by electric heater 33 and fed into gas line 34 in the direction shown by arrowheads.

At the end of gas line 34 is an upper manifold assembly 35 having a lower portion 21. This manifold is used to distribute gas from gas lines 34 and 36 to the heat exchanger and jet nozzle assembly 20. Manifold 35 contains a cavity 43 in which the pressurized gas from gas line 34 is divided equally into the heat exchanger tubes 22 and 23. The hot gas transfers part of its heat to the water through the walls of the heat exchanger tubes 22 and 23. The cooler gas exits the heat exchanger through upstanding tubes 24 and 26 that are connected to the lower portion 21 of manifold assembly 35. In cavity 44, gas from each heat exchanger tube is combined and diverted by the action of flow valve 38 to either the gas pump 31 by way of gas line 36, valve 38 and cold gas manifold 39, or when gas valve 38 is closed, the gas is directed through jet nozzle tube 25 to apertures 28. The jet nozzle tube 25 is lined with a plurality of apertures 28, and is capped at location 27. In addition to providing support, feet 29 are used to keep the assembly off the bottom of the sink 11 to improve the water circulation around the heat exchanger tubes 22 and 23.

Gas flow direction within the heat exchanging and jet nozzle tubes is shown at locations 15. Gas from cavity 44 which is not exhausted from the jet nozzles is ported to gas line 36. Gas line 36 is attached to flow valve 38 which is controlled by rotary solenoid or motor 37. With the flow valve 38 open, gas passes through the gas line 36 through the flow valve 38 into cold gas manifold 39 which supplies low pressure gas to the turbine compressor 31. With the flow valve 38 open the compressed gas generated by the turbine 31 repeats the cycle described above, i.e., it circulates through the heater 33, gas line 34, manifold 35, heat exchanger 23 and 24, back to the manifold 35, through gas line 36, through flow valve 38 and by way of the cold manifold 39 back to the turbine 31. In this open flow valve position, maximum heat is transferred to the dishwater 12, and agitation does not occur.

With the flow valve 38 closed so as to block gas passage from the gas line 36 to the cold manifold 39, gas is brought into the turbine compressor 31 through the open top of cold manifold 39. This gas is compressed by the turbine 31, heated by electric heater 33 and fed into gas line 34. The hot gas takes the same path previously described, but with the gas line 36 blocked by flow valve 38, the gas is forced into the jet nozzle tube 25 where it is forced through the jet nozzles 28. The gas forced through the nozzles 28 rises as generated bubbles in the water and expands to cause increased circulation and maximum turbulent agitation of the sink water 12.

By controlling the on-off duty cycle of the flow valve 38, the water turbulence levels can be controlled The greater the agitation the higher the heat loss of the water. Thus using a lower level of agitation requires less electrical power to maintain a given water temperature. A higher water temperature can be reached using less agitation. This type of control and temperature and pressure sensing is accomplished with the controller 40. The controller 40 monitors the pressure at port location 45 of the turbine compressor to ensure all connections are made. It also monitors the hot gas temperature at port location 41 and controls the heater voltage to maintain specified gas temperature. The return gas temperature monitored at port location 42 represents the sink water temperature. The controller can control the heater 33 and/or the flow valve 38 that controls agitation to maintain sink water temperature. If the water is removed, the temperature at location 42 rises rapidly, and the controller sensing this rapid rise turns off the heater 33. This will prevent hot gas or steam, resulting from loss of cooling by the heat exchanger, from being forced through the jet nozzles 28 and possibly causing damage to items in the sink or to employees. Also for safety purposes the jet nozzle holes are placed on the underside of the tubilar jet nozzle 25 to prevent direct contact with the hot gas. Although the heat exchanger 22 and 23 shown in FIGS. 1 and 2 are attached to the jet nozzles 25, other practical configurations and locations are possible as long as the heat from the hot gas is transferred to the water before being forced through the jet nozzles 25.

Figure 3:
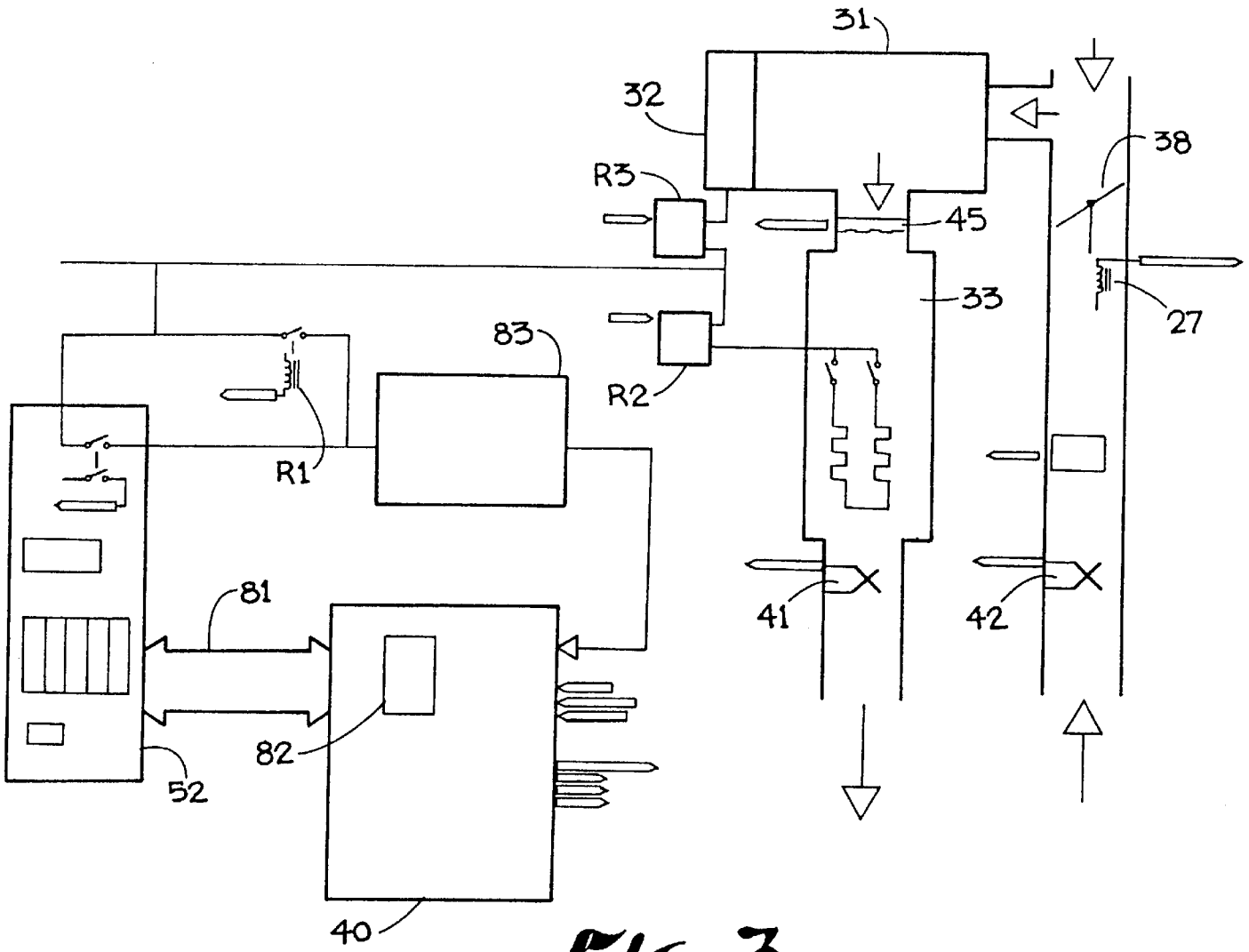
FIG. 3 presents a block diagram of the major elements associated with sensing and control logic, together with a mechanical schematic of the combined gas supply/heater/gas control system.

FIG. 3 presents a block diagram of the major elements associated with sensing and control logic, together with a mechanical schematic of the combined gas supply/heater/gas control system 30. Controller 40 contains a microprocessor 82 which is programmed to:

a) accept the outputs of the gas pressure sensor at port 45 and the temperature sensors at ports 41 and 42;
b) monitor, via logic cable 81, the state of all control switches from control panel 52 to determine the selected mode and state of the blower motor 32, heater 33 and flow valve 38; and
c) control the operation of blower motor 32 through relay R3, heater 33 through relay R2, solenoid 27.

In some modes heater 33 is controlled to maintain water temperature, in other modes the flow valve controls the temperature and agitation. The power input is controlled by the ON/OFF switch 53 located on the control panel. When turned on, power is applied to logic power supply 83. From this power supply, logic power is applied to controller 40. The controller in its start up routine energizes a power control relay R1 which bypasses the ON/OFF switch. The isolated contacts of the ON/OFF switch are also monitored by the controller via the control panel and logic cable. When the power switch is turned OFF, the controller is held ON by the power relay. The controller program then initiates a routine to shut the blower and heater off, keeping the blower on until the heater is cooled.

Figure 4:
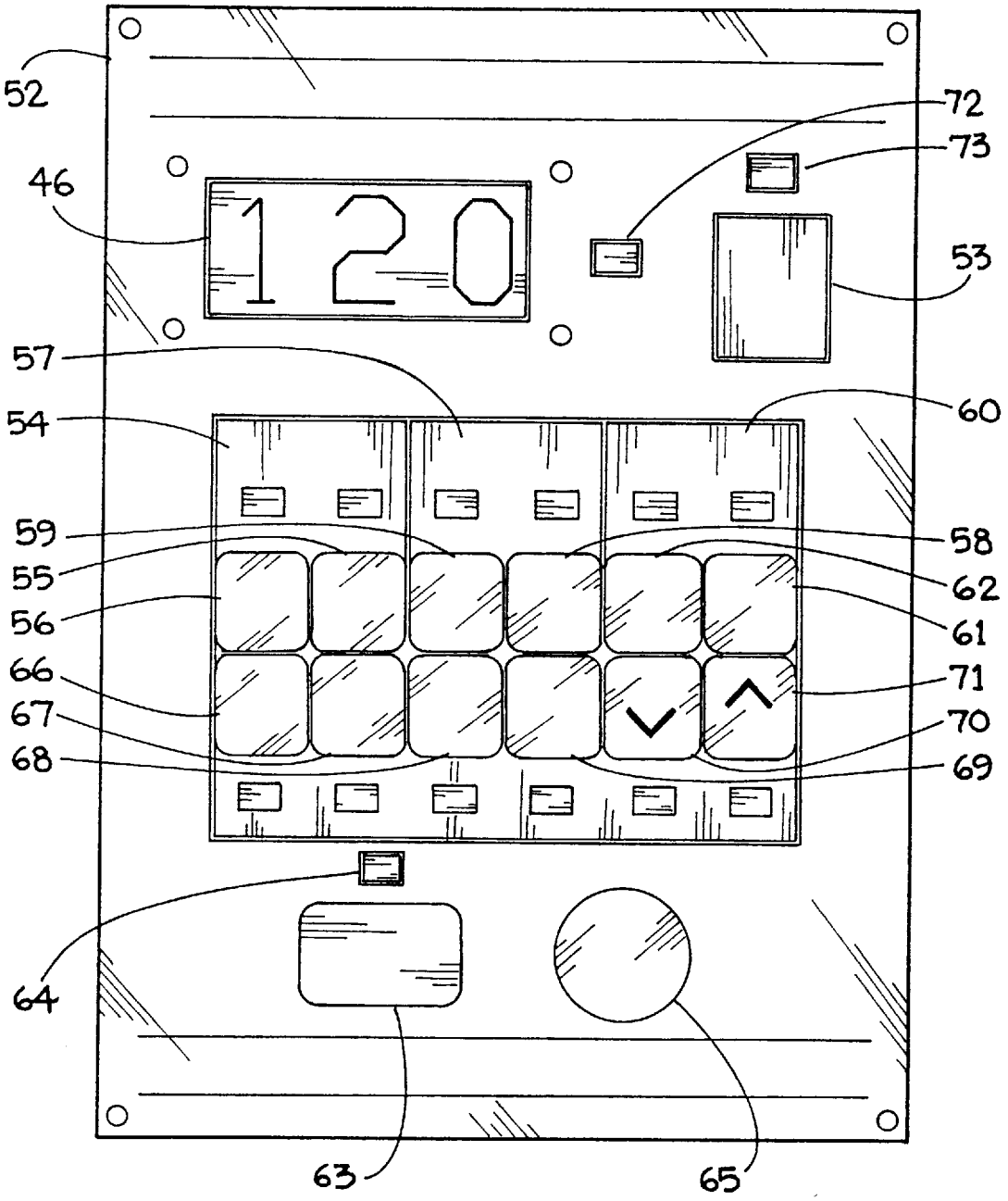
FIG. 4 shows an expanded view of the layout of a preferred embodiment of the control panel.

FIG. 4 shows an expanded view of the layout of a preferred embodiment of the control panel. WATER TEMPERATURE, derived from a temperature sensor at port location 42, is continuously indicated by Liquid Crystal Display (LCD) 46. This digital indicator is also used to set or change the various parameters that effect the washing action.

The function of each switch is as follows:

| | |
|---|---|
| ON - OFF | 53, controls main system power. |
| JET ACTION | 54, controls the level of agitation. |
| High | 55 for high agitation. |
| Normal | 56, for lower agitation and reduced power consumption. |
| TEMPERATURE | 57, for temperature control |
| High | 58, for washing without human hand contact. |
| Normal | 59, for a specified safe hand washing temperature. |
| CYCLE TIME | 60, for operational time selection. |
| Extended | 61, sets timer to long time period. |
| Normal | 62 sets timer to regular time period. |
| START CYCLE | 63, switch initiates cycle time, normal or extended. |
| Green | 64, LED indicates timer running. |
| READY | 65, light flashing - elapse of a preselected time period. |
| HEAT ONLY | 66 turns off agitation water. Temperature is reduced. |
| HOURS SET | 67, switch that controls selected hour. |
| MINUTES SET, | 68, switch that controls selected minute. |
| TEMP SET | 69, switch that controls selected temperature. |
| | 70, Down selection control. |
| | 71, Up selection control. |
| HEATING | 72, LED showing when power is applied to heater. |
| | 73, LED showing that unit power is on. |

Figure 5:
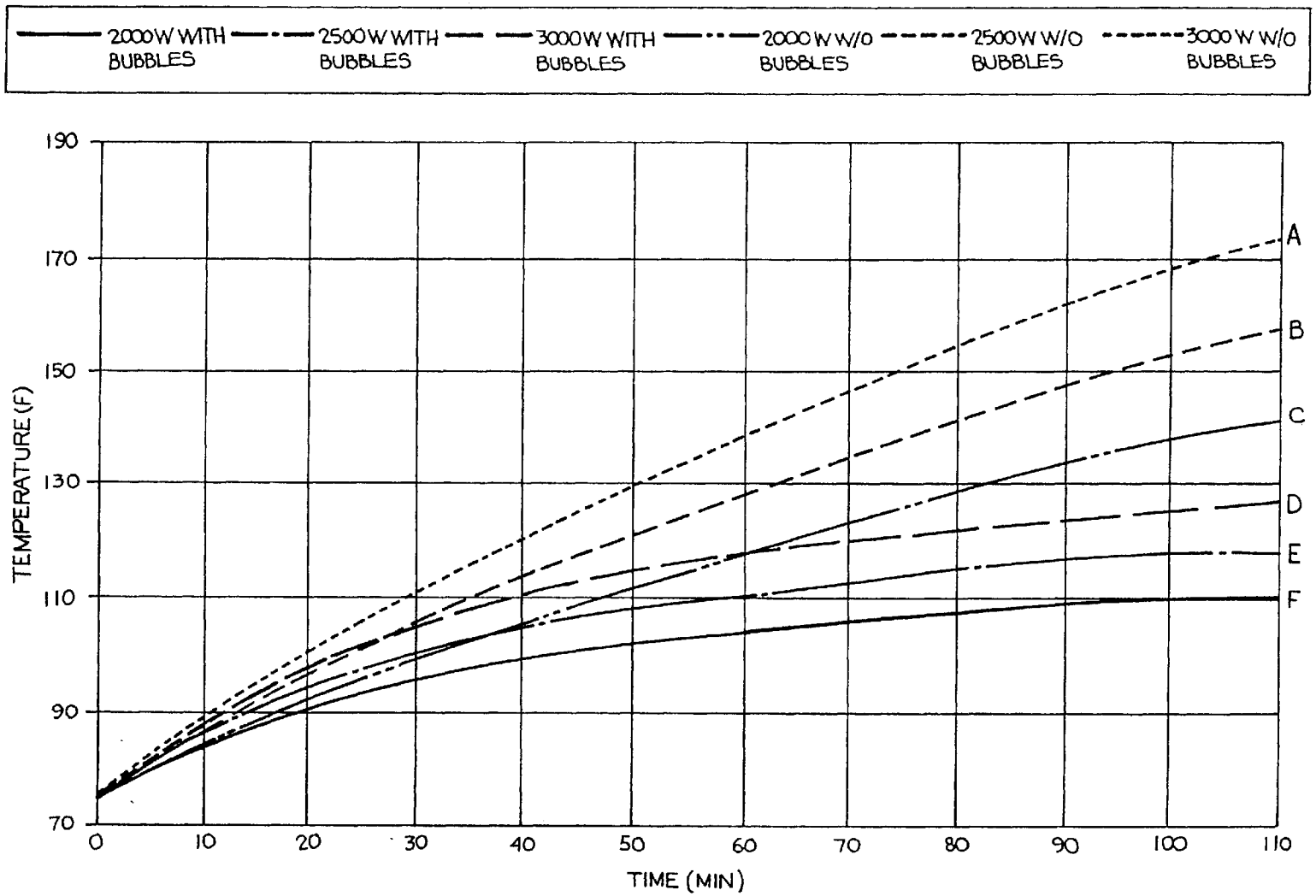
FIG. 5 is a graph comparing both heater power and water temperature rise vs. time, as a function of whether bubbles are being generated or not.

FIG. 5 shows a graph of experimental data comparing heater power, water temperature rise vs time as a function of turbulence measured by the extent of the bubble blowing. Curves labeled A, B and C were derived without forcing gas through jet nozzles 28, i.e., minimum bubbles and agitation. Curves D, E and F are curves derived by forcing gas through jet nozzles 28 to produce maximum bubbles and agitation. It is clearly seen that the water temperature rate of change and final temperature is a function of the agitation caused by the gas being forced through the jet nozzles 25.

Figure 6B:
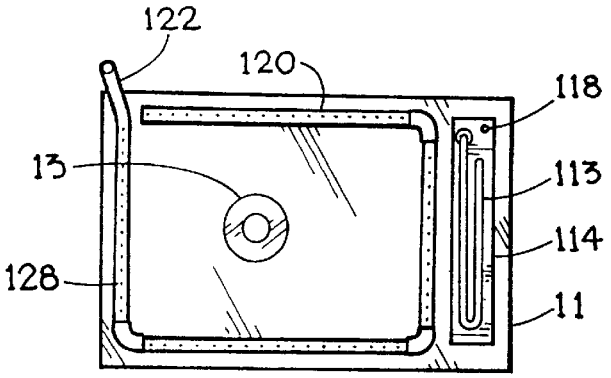
FIG. 6*b* is a top view of above sink, sectioned below the waterline.
Figure 6A:
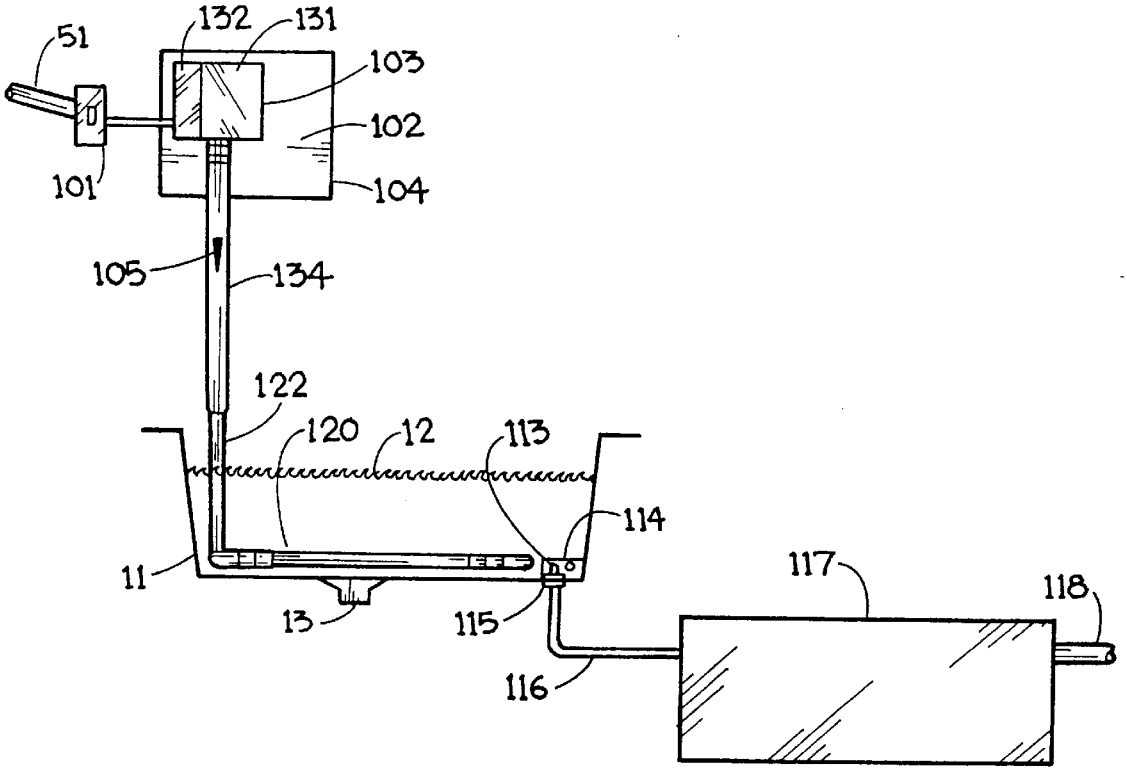
FIG. 6*a* presents a mechanical schematic of an alternate embodiment of a simpler system installed within a conventional sink.

It will be recognized that the gas heater and the manifolded heat exchanger may be replaced or supplemented by a separate immersion heater placed in the water. In this case, the system is made simpler, cheaper, and is easier to installed in existing sinks. FIGS. 6*a* and 6*b,* show two views of a first embodiment of such a simpler system 100. FIG. 6*a* is a mechanical schematic of the system installed within a conventional sink, with the sink shown as a front cross-section. FIG. 6*b* is a top view of the sink, sectioned below the waterline. Referring to FIG. 6*a,* a blower 131, enclosed in a box 102 and driven by motor 132, is used to compress the gas 103 flowing through vents 104 in the box. The gas is routed through a pipe or flexible tube 134, in the direction shown at position 105, to the upper end of riser tube 122. The lower end of riser tube 122 is attached to the lower portion of the jet assembly 120. Jet assembly 120 is disposed on the bottom of sink 11, which is filled with water and/or cleaning solution 12. The blower motor 132 obtains electrical power from power line 51 through an on/off switch 101. A conventional drain 13, is shown at the bottom of the sink 11.

Referring to FIG. 6*b,* the lower portion of the jet assembly 120 has numerous apertures 128 which will permit the gas to escape into the cleaning solution 12. The gas bubbles expand and rise causing turbulence, and the agitation scrubs clean the items in the sink. To heat the water so as to maintain its temperature, an immersion heater 113, is used. The heater is protected by cover 114 to prevent damage to the heaters from objects in the water and to protect against burning the operator. The immersion heater 113 receives its power through a water tight feed-through 115, control wires 116, and a temperature controller 117. The temperature controller 117, receives water temperature information from sensor 118, and adjusts the power to the immersion heater 113 to obtain the desired water temperature. Wires 118, show the input power connections to controller 117.

Figure 7B:
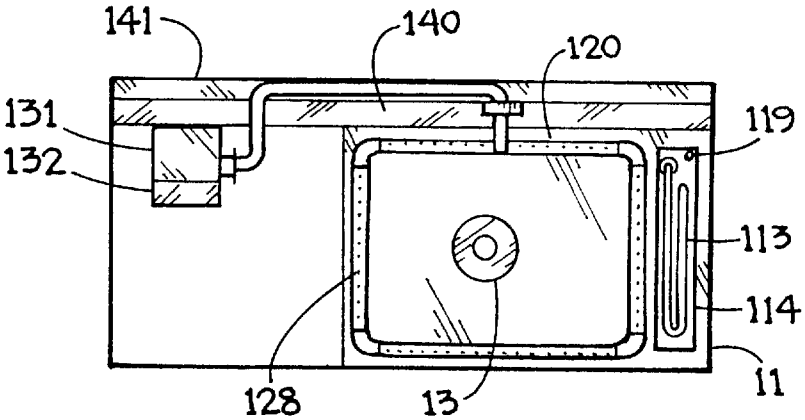
FIG. 7*b* shows the top view of the embodiment shown in FIG. 7*a*.
Figure 7A:
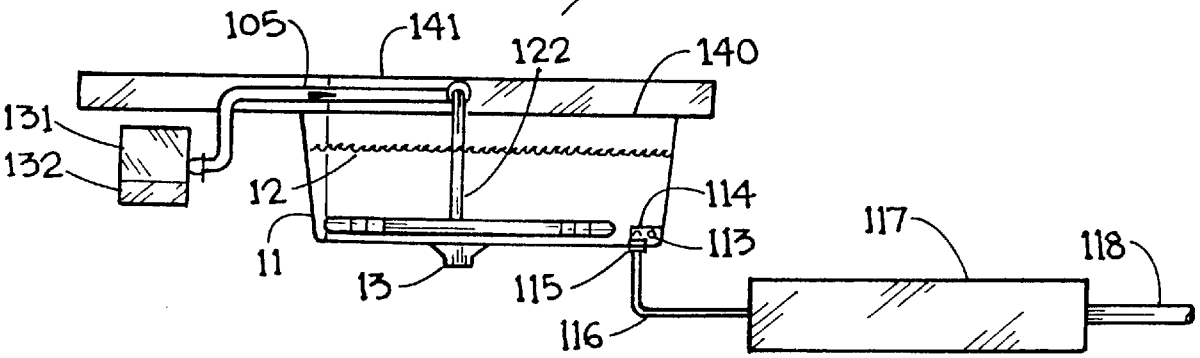
FIG. 7*a* presents a front cross-section of a sink in a second embodiment of the simpler system, in which the sink is built into a counter top.
Figure 7C:
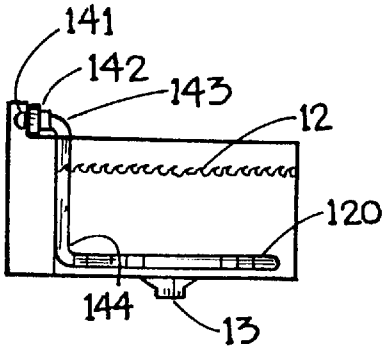
FIG. 7*c* shows the side view of the embodiment in FIG. 7*a*.

FIG. 7*a,* 7*b,* and 7*c* present a second embodiment 200, which may be used with a sink which is built into a counter top. FIG. 7*a* presents a front cross-section of sink 11, mounted in a counter top 140, which has a splash board 141. Blower 131 and motor 132 are supported under the counter top by base support means which are not shown. Gas from the blower flows in direction 105 to a gas junction with the upper end of riser tube 122. FIG. 7*b* shows the top view and FIG. 7*c* the side view of embodiment 200. Referring to these Figures, it will be seen that riser tube 122 is bent at locations 143 and 144, and has a removable coupling 142 so as to separate the upper end of riser tube 122 from the gas line. As with the other embodiments, it is important that any gas connecting lines which are immersed in the water be cleanable. This is necessary because the cleaning water becomes contaminated with food and sediment particles, and particles can be deposited in the gas lines when the gas pressure is turned off. Without gas pressure, the washwater will back flow into the gas channels.

The foregoing description and drawings were given for illustrative purposes only, it being understood that the invention is not limited to the embodiments disclosed, but is intended to embrace any and all equivalents, alternatives, modifications and rearrangements of elements falling within the scope of the invention as defined by the claims herein.

INDUSTRIAL APPLICABILITY

Although this invention has utility for cleansing many diverse articles, it has particular industrial applicability to the restaurant industry. In this environment, priority is given to fresh food preparation and sales at times of high demand. In between these periods, many routine maintence functions, including facility and dishware cleansing must be accomplished. In current practice, as pots, pans, utensils and other items required for the food production become dirty, they are generally placed in a sink for washing later. The extent of cleansing in the sink is usually limited to prewash functions such as soaking. Since this invention provides means for more complete automatic cleansing of dishware in the sink, in parallel with other preparation and serving functions, time and labor savings are obtained.

I claim:

1. Apparatus for cleaning dirty articles in a washing container, said washing container holding a liquid cleansing solution with a surface thereon, said apparatus comprising:

a base structure;

pressurized gas supply means;

gas heating means supported by said base structure outside of said liquid cleansing solution, said gas heating means being connected to said gas supply means;

hollow jet nozzle means, having opposite inlet and outlet ends thereon, said hollow jet nozzle means being disposed below the surface of said liquid cleansing solution, said outlet end of said hollow jet nozzle means being sealed, and a plurality of apertures being disposed along the surface of said hollow jet means for gas conduction therethrough; and first conduit means for gas communication from said gas heating means to the inlet end of said hollow jet nozzle means, whereby pressurized gas is forced outward from said plurality of apertures on said hollow jet nozzle means, thereby producing gas bubble jet streams which impact and agitate said liquid cleansing solution so as to scrub said dirty articles.

2. The apparatus for cleaning dirty articles as recited in claim 1, further comprising heating means supported by said base structure, said heating means being disposed below the surface of said liquid cleansing solution so as to increase the temperature of said liquid cleansing solution whereby the cleansing of said dirty articles is improved.

3. The apparatus for cleaning dirty articles as recited in claim 2, further comprising temperature sensing means for measurement of the temperature of said liquid cleansing solution.

4. The apparatus for cleaning dirty articles as recited in claim 3, further comprising temperature controlling means for regulation of the temperature of said liquid cleansing solution.

5. The apparatus for cleaning dirty articles as recited in claim 4, wherein said pressurized gas supply means comprises gas pumping means.

6. The apparatus for cleaning dirty articles as recited claim 5, wherein said gas pumping means is driven by electric motor means.

7. The apparatus for cleaning dirty articles as recited in claim 6, wherein said heating means is electrically operated.

8. The apparatus for cleaning dirty articles as recited in claim 7, wherein said washing container comprises free standing sink means.

9. The apparatus for cleaning dirty articles as recited in claim 7, wherein said washing container comprises sink means supported on a counter top.

10. The apparatus for cleaning dirty articles as recited in claim 2, further comprising:

heat exchanging means supported by said base structure below the surface of said liquid cleansing solution; and second conduit means for gas communication from said gas heating means to said heat exchanging means, whereby heat from gas heated by said gas heating means is transferred into said liquid cleansing solution as to increase the temperature of said liquid cleansing solution.

11. The apparatus for cleaning dirty articles as recited in claim 10, wherein said heat exchanging means comprises a plurality of hollow tubing means connected to said second conduit and outlet means for return of said heated gas to said pressurized gas supply means.

12. The apparatus for cleaning dirty articles as recited in claim 11, further comprising manifold means for delivering said heated gas from said gas heating means to both hollow jet nozzle means and to the inlet means of said plurality of hollow tubing means.

13. The apparatus for cleaning dirty articles as recited in claim 12, wherein said manifold means further collects said heated gas from said outlet means of said plurality of hollow tubing means for said heated gas return to said pressurized gas supply means.

14. The apparatus for cleaning dirty articles as recited in claim 13, further comprising temperature regulation means for the heated gas return from said manifold means.

15. The apparatus for cleaning dirty articles as recited in claim 14, wherein said temperature regulation means for the heated gas return comprises means for proportioning of the mixture of said heated gas returned from said manifold means with the unheated ambient gas.

16. The apparatus for cleaning dirty articles as recited in claim 15, further comprising bypass valve means to control the proportioning of the mixture of the heated gas return from said manifold means and the unheated ambient gas by restriction of the flow of the heated gas return from said manifold means.

17. The apparatus for cleaning dirty articles as recited in claim 16, further comprising a microprocessor controller to control all said pressurized gas supply means, said gas heating means, said heating means, said temperature controlling means, said temperature regulation means, said means for proportioning and said bypass valve means.

18. A method of cleaning dirty articles in a washing container holding a liquid cleansing solution which comprises the steps of:

providing a base structure;

supplying a pressurized gas by pressurized gas supply means;

heating the gas outside of said liquid cleansing solution by gas heating means;

disposing hollow jet nozzle means below the surface of said liquid cleansing solution, said hollow jet nozzle means having an inlet end and a sealed outlet end, and having a plurality of apertures thereon for gas conduction therethrough; and delivering said heated pressurized gas to said hollow jet nozzle means by first conduit means, whereby said heated pressurized gas is forced outward from said plurality of apertures on said hollow jet nozzle means, thereby producing gas bubble jet streams which agitate said liquid cleansing solution so as to scrub said dirty articles.

19. The method of cleaning dirty articles as recited in claim 18, further comprising the step of heating the liquid cleansing solution by heating means supported by said base structure, said heating means being disposed below the surface of said liquid cleansing solution as to increase the temperature of said liquid cleansing solution whereby the cleansing of said dirty articles is improved.

20. The method of cleaning dirty articles as recited in claim 19, further comprising the step of sensing the temperature of said liquid cleansing solution.

21. The method of cleaning dirty articles as recited in claim 20, further comprising the step of controlling the temperature of said liquid cleansing solution.

22. The method of cleaning dirty articles as recited in claim 21, wherein said pressurized gas supply means comprises a gas pump.

23. The method of cleaning dirty articles as recited in claim 22, further comprising the step of driving said gas pump by electric motor means.

24. The method of cleaning dirty articles as recited in claim 19, further comprising the step of transferring a portion of the heat from the heated gas into said liquid cleansing solution, within heat exchanging means supported by said base structure below the surface of said liquid cleansing solution connected to said gas heating means by second conduit means, so as to increase the temperature of said liquid cleansing solution.

25. The method of cleaning dirty articles as recited in claim 24, wherein said heat exchanging means comprises a plurality of hollow tubing means having inlet end means connected to said gas heating means and outlet end means connected to said pressurized gas supply means for return of cooler gas to said pressurized gas supply means.

26. The method of cleaning dirty articles as recited in claim 25, further comprising the step of diverting said heated gas from said gas heating means to both said hollow jet nozzle means and to the inlet end means of said plurality of hollow tubing means by manifold means.

27. The method of cleaning dirty articles as recited in claim 26, wherein said manifold means further collects said cooler gas from said outlet end means of said plurality of hollow tubing means for said cooler gas return to said pressurized gas supply means.

28. The method of cleaning dirty articles as recited in claim 27, further comprising the step of regulating the temperature of said cooler gas return from said manifold means.

29. The method of cleaning dirty articles as recited in claim 18, further comprising the steps of:

draining the liquid cleansing solution from said washing container;

rinsing said dirty articles with clean water; and drying the cleaned articles with pressurized heated gas flowing through said jet nozzle means.

* * * * *